United States Patent [19]

Yamada

[11] 4,449,836

[45] May 22, 1984

[54] PRINTING HEAD FOR WIRE DOT PRINTER

[75] Inventor: Noboru Yamada, Yokohama, Japan

[73] Assignee: Tokyo Shibaura Denki Kabushiki Kaisha, Kawasaki, Japan

[21] Appl. No.: 405,084

[22] Filed: Aug. 4, 1982

[30] Foreign Application Priority Data

Aug. 24, 1981 [JP] Japan ..... 56-132505

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 3,672,482 6/1972 Brumbaugh et al. ..... 400/124

3,994,381 11/1976 Hebert ..... 400/124

4,136,978 1/1979 Bellinger, Jr. et al. ..... 400/124

*Primary Examiner*—Paul T. Sewell

*Attorney, Agent, or Firm*—Oblon, Fisher, Spivak, McClelland & Maier

[57] ABSTRACT

A printing head for a wire dot printer having printing wires each of which is attached to an armature, wire driving mechanisms for reciprocating the printing wires in a first direction, each having the armature moved in the first direction, a magnetic frame including an air gap in which the armature is received swingably in the first direction, a magnetizing coil for generating a magnetic flux in the air gap, a sliding portion formed in the magnetic frame for adjusting the length of the air gap, and an armature support member attached to the magnetic frame to resiliently support the armature, the armature support member being slidable not only in the first direction but also in a second direction which is perpendicular to the first direction so that the free position of the armature may be adjustable independently of the adjustment of the length of the air gap.

5 Claims, 6 Drawing Figures

PRINTING HEAD FOR WIRE DOT PRINTER

BACKGROUND OF THE INVENTION

The present invention relates to a printing head for the wire dot printer comprising a plurality of printing wires having front and back end portions arranged in a predetermined distribution; and wire driving means for driving back ends of printing wires so as to move their front ends in a dot printing direction and in a returning direction; each of wire driving means having an armature moved in a first direction so as to drive the back end of printing wire; a magnetic frame comprising a plurality of magnetic members arranged along a plane or reference plane including the first direction, and including at least one soft magnetic member and at least one permanent magnet; plural magnetic members being connected in series to form a magnetic circuit provided with an air gap; an exciting coil wound around the magnetic frame and generating a magnetomotive force, when excited, so as to offset the magnetomotive force of the permanent magnet; and an armature support means attached to the magnetic frame and resiliently supporting the armature movable in the air gap in the first direction.

This type of printing head for wire dot printers are variously known. The armature for driving a printing wire is arranged in an air gap between two pole tips attached to a magnetic frame. The armature is drawn by the action of a permanent magnet, which is arranged in the magnetic frame, to the pole tip which is in the returning direction of the printing wire, and the force for moving the armature in a direction that causes the printing wire to hit a platen is stored in the armature support means.

When current is supplied to an exciting coil is this state, the exciting coil generates a magnetomotive force that offsets the magnetomotive force of the permanent magnet. Therefore, the armature and printing wire is released from the electromagnetic drawing force and is driven in its dot printing direction by the resilient force of the armature support means. When this dot printing operation is finished, current supply to the coil is stopped and the armature is again down to the pole tip on its returning side, ready for a subsequent printing operation.

The printing or letters of symbols through printing wires is achieved by selectively causing a plurality of printing wires arranged in a predetermined distribution to hit the platen using their corresponding wire driving means. The fundamental matter necessary to achieve excellent printing is for each of wires to hit the platen with substantially equal force. This makes it necessary to equalize the material quality and process accuracy of relative components and also requires that the length of air gap corresponding with the armature be optimally adjusted. The adjustment of air gap length means that the amount of resilient energy charged in the armature, which is drawn to the pole tip on its returning side, is set to an optimum value. However, conventional printing heads make it difficult to carry out this adjustment. With conventional printing heads or printing heads disclosed by an early-opened Japanese Patent Application No. 52-49119, for example, the two members between which the air gap was provided were connected with each other along a plane substantially perpendicular to the direction of air gap and fixed to each other by means of screws arranged perpendicular to the plane.

As a result, the adjustment of air gap length made it necessary to detach screws from both members, separate both members from each other, insert a spacer between both members, and thread the screws again to connect both members. This process must usually be repeated a number of times. In addition to this troublesome and difficult adjustment, many spacers having various kinds of thickness must be prepared beforehand to achieve this adjustment.

SUMMARY OF THE INVENTION

The object of the present invention is to provide a printing head for wire dot printers wherein the length of the air gap formed in a magnetic circuit of each of wire driving means can be adjusted without using any air gap adjusting spacers.

To achieve the object of the present invention, a printing head for wire dot printers according to the present invention is characterized in that at least one connecting portion of a plurality of magnetic members included in the magnetic frame is provided on both the to-be-connected magnetic members, respectively, and these connecting portions are slidably connected to each other in the first direction so as to allow the length of air gap to be adjusted using the sliding planes of including both the first direction and a second direction perpendicular to the reference plane, and that both magnetic members are fixed each other by screws arranged substantially perpendicular to both magnetic members, said screw serving to press both magnetic members against each other, and being provided with a clearance around them, respectively.

The printing head according to the present invention having such characteristics that enable both magnetic members to be shifted relative to each other within a range determined by the clearance, when the screw are loosened. Therefore, the length of air gap can be adjusted in the range determined by the clearance, and the length of the air gap thus adjusted can be fixed by retightening screws. As described above, the air gap can be continuously adjusted in length without inserting any spacer between both magnetic members, thus making it unnecessary upon adjustment to separate both magnetic members from each other and then assemble them.

According to the preferred embodiment of the present invention, the free positioning of the armature arranged in the air gap is possible in first and second directions. This free position of the armature is a position which the armature supported in the air gap by armature support means, takes when the exciting force of the permanent magnet is completely offset by the exciting force of the exciting coil. In order to adjust the free position of the armature, the armature support means is provided with a non-magnetic block attached to the magnetic frame and the armature is supported through a resilient plate on the non-magnetic block. The non-magnetic block and magnetic frame are attached to each other, with their sliding planes overlapping. Both sliding planes include first and second directions. The non-magnetic block and magnetic frame are also fixed to each other by screw means arranged substantially perpendicular to their sliding planes and provided with a clearance around them, respectively. Therefore, the non-magnetic block or the free position of the armature can be adjusted relative to the magnetic frame with in the range allowed by the clearance, when screw are slightly loosened. The position thus adjusted can be fixed by retightening of the screw means. Similar to air gap adjustment, the adjustment of free position can be easily achieved without using any spacers. The free position adjustment of the armature in the second direction is intended to locate the armature at the optimum position in a direction perpendicular to the direction in which the air gap extends, and the free position adjustment of the armature in the first direction is intended to optimize the length of printing wire projected toward the platen at its dot printing time. These adjustments are important to achieve excellent dot printing. Capability of easy achievement of these adjustments enhances the use of printing heads for wire dot printers.

DETAILED DESCRIPTION OF PREFERRED EMBODIMENT

Figure 1:
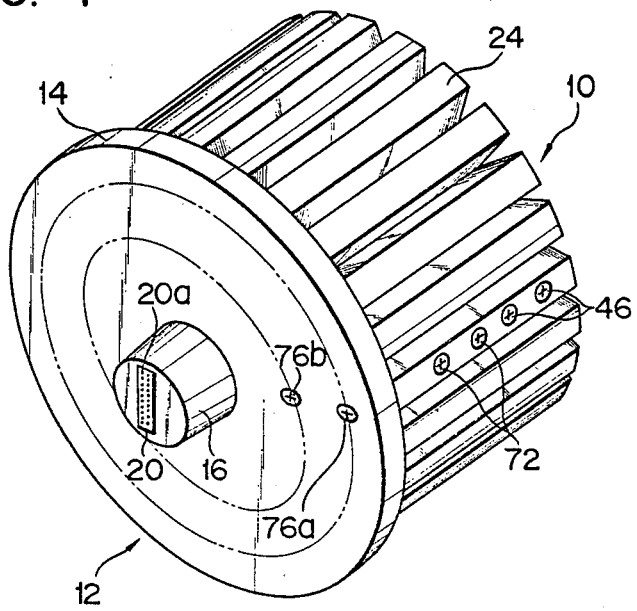
FIG. 1 is a perspective view showing an example of printing head for wire dot printers according to the present invention.

An embodiment of the present invention will be described referring to FIGS. 1, 2 and 3. A printing head 10 substantially cyclindrical and provided with a base member 12 at one axial end thereof. The base member 12 comprises a substantially circular flange 14, and a guide sleeve 16 projected from the center of the flange 14 in the axial direction and provided with a through hole 18 penetrating therethrough in the axial direction. To the foremost end of guide sleeve 16 is attached a guide block 20 having a plurality of guide bores 20*a* arranged with a predetermined distribution and substantially parallel to the axial direction.

Figure 3:
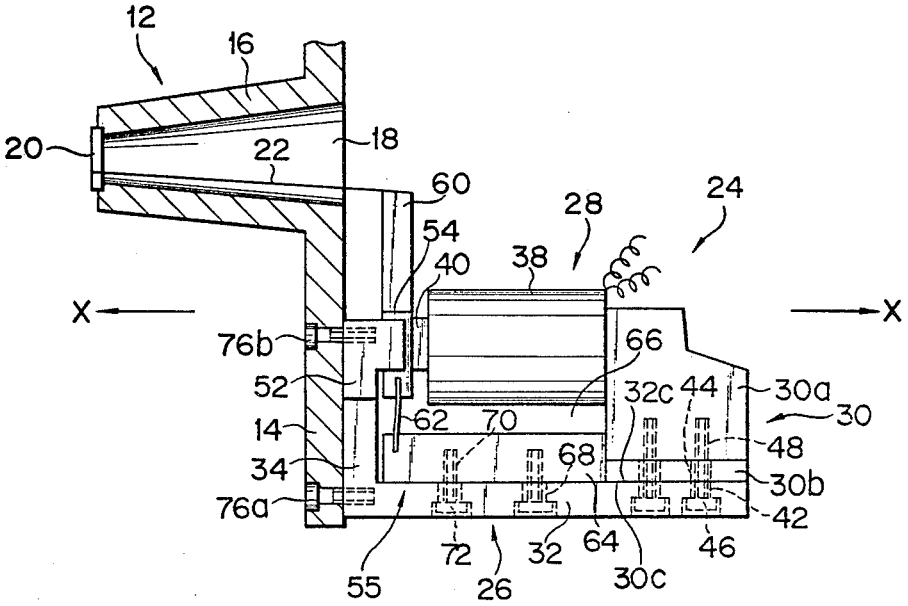
FIG. 3 is a partial section side view of the printing head shown in FIG. 1.

As shown in FIG. 3, one end of a printing wire 22 is penetrated through each of guide bores 20*a* while the other end thereof is attached to a wire driving means 24. Wire driving means 24 are the same in number as printing wires 22 and are attached to the inner face of flange 14 of base member 12 in such a way that they are along the predetermined radial reference planes P arranged on the inner face of flange 14 and have the same angle between them.

Figure 4:
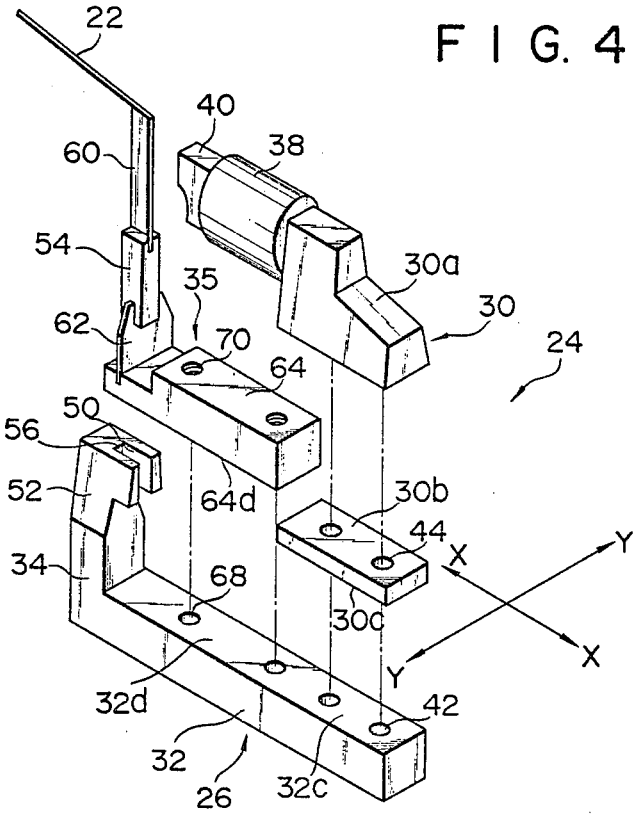
FIG. 4 is a perspective view showing wire driving means of FIG. 3 disassembled.

Referring to FIGS. 3 and 4, each of wire driving means 24 has a substantially rectangular four-sided magnetic frame 26 provided with an air gap and radially attached to the flange 14 of base member 12 along one of reference planes P. As shown in FIG. 4, the magnetic frame 26 is a combination of first and third sides 28 and 32 extending in left and right directions with a space interposed therebetween, and of second and fourth sides 30 and 34 extending substantially perpendicular to first and third sides. The direction in which first and third sides 28 and 30 extend is representedby X—X in FIGS. 3 and 4 will be hereinafter referred to as first direction. First, third and fourth sides 28, 32 and 34 of magnetic frame 26 are made of soft magnetic material such as soft iron and the second side 30 includes an intermediate member 30*a* made of soft magnetic material and a permanent magnet 30*b*. An air gap is provided between first and fourth sides 28 and 34, and a pole tip 40 is formed on the foremost end of first side 28 which is directed toward the air gap. An exciting coil 38 which is to be wound around the magnetic frame 24 is wound around the first side 28 in this embodiment. Although third and fourth sides are made integral as shown in FIGS. 3 and 4, they may be differently produced and processed and then combined with each other according to the well known manner. The first side 28 and intermediate member 30*a* may also be made integral or may be produced differently to assemble an integral component. As shown in FIG. 4, the connection between the second side 30, which includes the intermediate member 30*a* and permanent magnet 30*b*, and the third side 32 is a slidable plane connection between sliding planes formed on the permanent magnet 30*b* and third side 32, that is, sliding planes 30*c* and 32*c* including a second direction perpendicular to the reference plane P (FIG. 2) represented by Y—Y in FIG. 3, and the first direction. The fixing between second and third sides 30 and 32 is achieved by inserting a screw 46 through clearance holes 42 and 44 provided in the third side 32 and permanent magnet 30*c* and then threading it into a screw hole 48 provided in the intermediate member 30*a*. Screws 46 can be loosened to shift second and third sides 30 and 32 relative to the first direction to the extent permitted by the clearance formed between each of screws 46 and clearance holes 42 and 44, and then threaded again, to easily and continuously adjust the length of air gap without inserting a spacer between both sides 30 and 32 and without adjusting the width of the spacer inserted therebetween.

Two projections 52 are projected from the foremost end of fourth side 34 to form a vertical through groove 50 of FIGS. 3 and 4 opposite to the pole tip 40 of first side 28. An armature 54 cooperating with the four-sided magnetic frame 26 is supported, movable in the first direction, in a space enclosed by the pole tip 40 and projections 52. The armature 54 shown in FIG. 3 is drawn to the pole tip 40 by the action of permanent magnet 30*b*, forming a clearance between the bottom 56 of vertical groove 50 and the armature 54. When power is supplied to the exciting coil 38 under this condition, the magnetomotive force of permanent magnet 30*b* is off-set by the magnetomotive force generated by the exciting coil 38, and the armature 54 is moved by a resilient plate 62 in the first direction or in the left direction in FIG. 3, departing from the pole tip 40, as will be described later. The armature is provided with an arm 60 arranged on the reference plane P and perpendicular to the first direction, said arm 60 having the printing wire 22 attached to the foremost end thereof. The armature 54 extends downward in FIG. 3, passing through the vertical groove 50, and has the resilient plate 62 attached to the lowermost end thereof. The resilient plate 62 capable of curving in the first direction extends vertically in FIG. 3 and is fixed by a non-magnetic block 64 at the lowermost end thereof. Said non-magnetic block 64 is made of a material such as stainless steel and copper alloy. The non-magnetic block 64 is arranged inside a window 66 enclosed by first, second, third and fourth sides 28, 30, 32 and 34, and attached to the third side 32. The connection between the non-magnetic block 64 and the third side 32 is achieved, slidable in first and second directions, by contacting sliding planes 64*d* and 32*d* with each other as shown in FIG. 4, said sliding planes 64*d* and 32*d* being formed on both members 64 and 32 and including first and second directions. The fixing between the non-magnetic block 64 and the third side 32 is achieved by threading a screw 72 into a clearance hole 68 and a screw hole 70 provided substantially perpendicular to sliding planes 32*d* and 64*d* and in the third side 32 and in non-magnet block 64. When screws 72 are loosened to shift the non-magnetic block 64 relative to the third side 32 in any of first and second directions and to the extent necessary within the range permitted by the clearance between the clearance hole 68 and the screw 72, and then threaded again, the non-magnetic block 64 and third side 32 can be firmly connected with each other. The shift of non-magnetic block 64 in the first direction is intended to adjust the length of printing wire 22 projected from the guide block 20 when the printing wire 22 prints a dot, while its shift in the second direction is intended to adjust the armature 54 in the vertical groove 50 formed on the foremost end of fourth side 34 in such a way that the armature 54 is positioned in the center of vertical groove 50 when viewed in the second direction. The non-magnetic block 64, resilient plate 62 and screws 72 form an armature supporting means 35 for supporting the armature 54 in the air gap 36. When no magnetic field is formed in the air gap or when the exciting force of permanent magnet 30*b* is completely offset by the action of exciting coil 38, for example, the armature 54 is supported in a free position which is determined by the property of resilient plate 62. However, the armature 54 is usually drawn to the pole tip 40 by the action of permanent magnet 30*b*, causing the resilient plate 62 to be curved in the right direction in FIG. 3. In the resilient plate 62 is stored, at this time, resilient energy corresponding to the distance of armature 54 moved from its free position to the pole tip 40.

Figure 2:
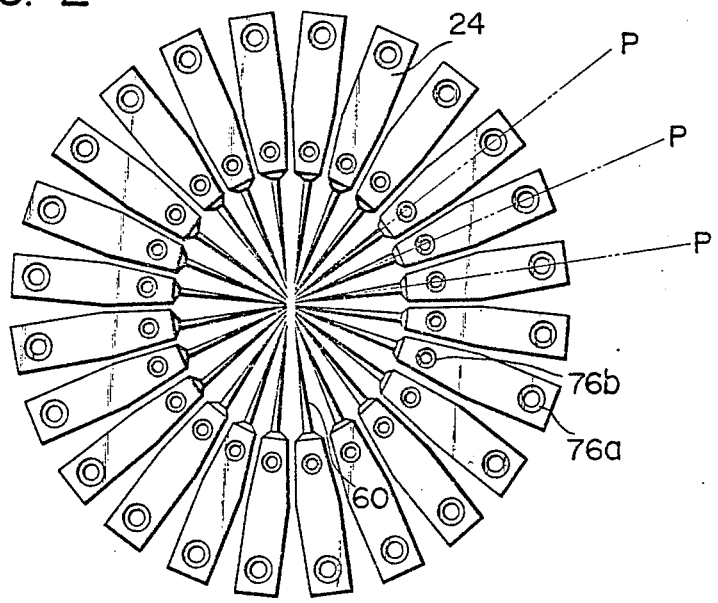
FIG. 2 is a view showing the arrangement of wire driving means employed in the printing heads of FIG. 1 and obliquely viewed from the left side when a base member is removed.

Wire driving means 24 arranged radially as shown in FIG. 2 to the flange 14 are attached using screws 76*a* and 76*b* threaded into the fourth side 34 through the flange 14 (see FIGS. 2 and 3).

The operation of printing head 10 according to the present invention will be now described. The printing operation of this printing head 10 is achieved by selecting those wire driving means 24 which are to drive printing wires corresponding to a letter or symbol to be printed, and then supply power to their exciting coils 38. The power supply is achieved by a control means (not shown) connected to the printing head 10. When the exciting coil 38 is not excited, the armature 54 is drawn to the pole tip 40 against the force of resilient plate 62 by the action of permanent magnet 30*b*. When current is applied to the exciting coil 38, magnetomotive force generated by the exciting coil 38 substantially overcomes the magnetomotive force of the permanent magnet 30*b*, thus causing the armature 54 to move, departing from the pole tip 40, in the first direction by the action of resilient plate 62. This movement of armature 54 is transmitted through the arm 60 to the printing wire 22, which is thus projected through the guide bore 20*a* of guide block 20 to hit the surface of a platen (not shown). When the dot-hitting operation is finished and current supply to the exciting coil 38 is stopped by the control means, the armature 54 is again drawn to the pole tip 40 by the action of permanent magnet 30*b* and ready for a subsequent dot-hitting operation.

For the purpose of achieving excellent letter printing using the printing head for use to the wire dot printer, it is usually necessary that each of wire driving means 24 be allowed to hit the platen with substantially equal force. Each wire driving means is therefore finished after making various kinds of adjustments. The first is to adjust the length of air gap, the second to adjust the armature 54 to be positioned substantially in the center of projections 52 projected from the fourth side 34, and the third to adjust the length of printing wires 22 projected through the guide block 20 at the time of impact with the platen. According to the embodiment of the present invention described above, the first adjustment can be easily attained by slightly loosening screws 46 threaded into the second side 30, shifting second and third sides 30 and 32 along their sliding planes 30*c* and 32*c*, and then threading screws 46 firmly again. The second and third adjustments are made by slightly loosening screws 72 threaded into the non-magnetic block 64, shifting the non-magnetic block 64 and third side 32 in second and first directions along their sliding planes 64*d* and 32*d*, and then threading screws 72 firmly again.

Figure 5:
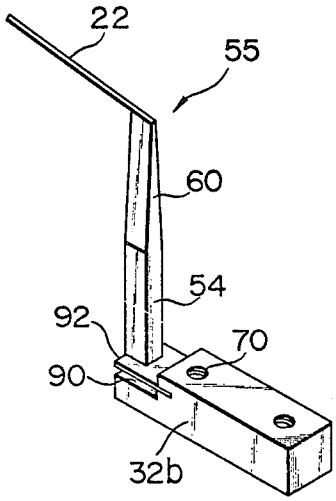
FIG. 5 is a perspective view showing a modification of armature support means of FIG. 4
Figure 6:
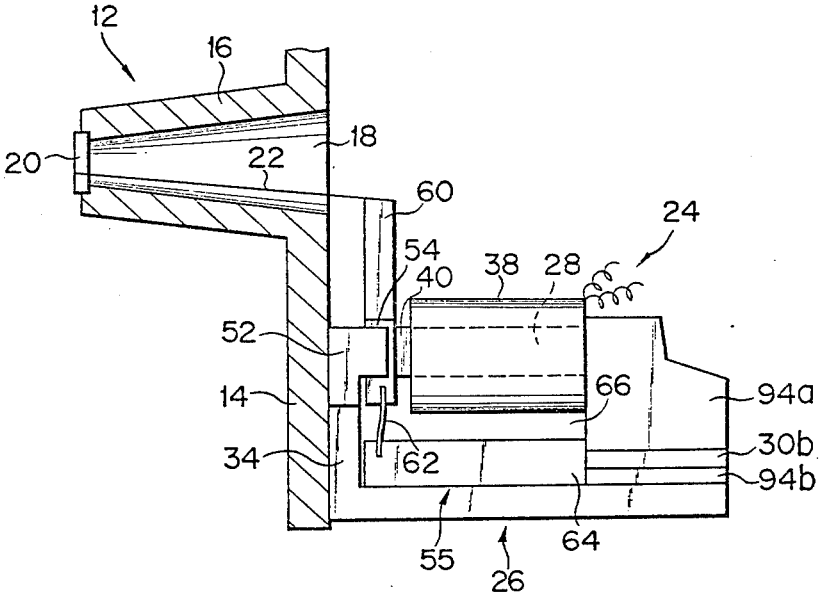
FIG. 6 is a partial section side view showing a modification of wire driving means.

It should be understood that the present invention is not limited to the above described embodiment but may be modified to various kinds of versions. Although the resilient plate 62 has been held substantially perpendicular to the surface of non-magnetic member 64, a stepped portion 90 may be provided on the non-magnetic block 64 and a resilient plate 92 be held substantially parallel to the third side section 32*b*, for example, as shown in FIG. 5. In addition, the second side 30 may comprise two soft magnetic members 94*a* and 94*b* and permanent magnet 30*b* and the permanent magnet 30*b* arranged between two members 94*a* and 94*b*, for example, as shown in FIG. 6.

What is claimed as new and desired to be secured by letters patent of the United States is:

1. A printing head for wire dot printer comprising:

a plurality of printing wires having front and back end portions arranged in a predetermined distribution, respectively; and wire driving means for driving the back ends of said printing wires to move said printing wires both in a dot printing direction and in a returning direction, each of said wire driving means including an armature moved in a first direction so as to drive the back end of said printing wire, a magnetic frame comprising a plurality of magnetic members arranged in a reference plane including said first direction and having at least one permanent magnet and at least one soft magnetic member, said plural magnetic members being connected in series to form a magnetic circuit provided with an air gap, at least one connecting portion of said plural magnetic members included in said magnetic frame being defined by two of said magnetic members which are slidable relative to one another in the first direction, at connecting sliding surfaces so that the length of the air gap may be adjusted by the sliding movement, said sliding surfaces defining sliding planes including both a second direction perpendicular to the reference plane and the first direction, said connecting portion having screws arranged substantially perpendicular to said sliding surfaces and pressing said two magnetic members one against the other and substantially perpendicular to said both of said sliding surfaces, an exciting coil wound around said magnetic frame and generating a magnetomotive force, when excited, to substantially off-set the magnetomotive force of said permanent magnet, and an armature support means attached to said magnetic frame to resiliently support said armature movable in the air gap in the first direction, said armature support means being slidable in both the first and second directions relative to said magnetic frame, to thereby adjust the free position of said armature in the air gap.

2. A print head according to claim 1 wherein said armature support means has a non-magnetic block attached to said magnetic frame via second sliding surfaces formed on said non-magnetic block and on said magnetic frame and a spring erected on said non-magnetic block and resiliently supporting said armature movable in the air gap in the first direction, said non-magnetic block and magnetic frame are connected to each other, slidable both in the first direction and in the second direction perpendicular to the reference plane by overlapping their sliding surfaces one upon the other, their sliding surfaces being parallel to the first direction and being perpendicular to the reference plane, and said magnetic frame and non-magnetic block are fixable to each other by means of screw means arranged perpendicular to their sliding surfaces so as to press said block and frame one against the other, said screw means being provided with a clearance around them, respectively.

3. A printing head according to claim 1 wherein said magnetic frame is made substantially rectangular having first, second, third and fourth side sections, said first and third side sections being directed in the first direction while said second and fourth side sections extending substantially perpendicular to the first direction, said air gap is formed between the first and fourth sections, said permanent magnet is provided on said second side section, and said sliding surfaces are formed where said second and third side sections are to be connected each other.

4. A printing head according to claim 2 wherein said magnetic frame is made substantially rectangular having first, second, third and fourth side sections, said first and third side sections being directed in the first direction while said second and fourth side sections extending substantially perpendicular to the first direction, said air gap is formed between said first and fourth sections, said permanent magnet is provided on said second side section, and said sliding surfaces are formed where said second and third side sections are to be connected to each other.

5. The printing head of claim 4 including a base member through which front ends of said printing wires extend for printing, wherein said non-magnetic block is attached to said third side section and said fourth side section is fixed to said base member.

* * * * *